US010680344B2

(12) United States Patent
Murata et al.

(10) Patent No.: US 10,680,344 B2
(45) Date of Patent: Jun. 9, 2020

(54) ANTENNA DEVICE

(71) Applicant: Panasonic Corporation, Osaka (JP)

(72) Inventors: Tomohiro Murata, Kanagawa (JP); Junji Sato, Tokyo (JP)

(73) Assignee: Panasonic Corporation, Osaka (JP)

( * ) Notice: Subject to any disclaimer, the term of this patent is extended or adjusted under 35 U.S.C. 154(b) by 7 days.

(21) Appl. No.: 16/270,940

(22) Filed: Feb. 8, 2019

(65) Prior Publication Data

US 2019/0252795 A1 Aug. 15, 2019

(30) Foreign Application Priority Data

Feb. 15, 2018 (JP) ..... 2018-025032

(51) Int. Cl.
*H01Q 21/00* (2006.01)
*H01Q 1/52* (2006.01)
*H01Q 5/30* (2015.01)

(52) U.S. Cl.
CPC ..... *H01Q 21/0025* (2013.01); *H01Q 1/523* (2013.01); *H01Q 5/30* (2015.01)

(58) Field of Classification Search
USPC ..... 343/700 MS, 824, 893
See application file for complete search history.

(56) References Cited

U.S. PATENT DOCUMENTS

2011/0080314 A1 4/2011 Wintermantel
2013/0027259 A1* 1/2013 Fujita ..... H01Q 9/0478 343/731
2014/0333502 A1 11/2014 Uno et al.
2016/0248159 A1* 8/2016 Shiozaki ..... H01Q 7/00
2016/0380362 A1* 12/2016 Cheng ..... H01Q 21/0006 343/700 MS
2019/0131715 A1* 5/2019 Zhou ..... H01Q 1/38

FOREIGN PATENT DOCUMENTS

JP 2011-526370 A 10/2011
WO 2014/045519 A1 3/2014

OTHER PUBLICATIONS

Kazuo Shirakawa et al., "3D-Scan Millimeter-Wave Radar for Automotive Application", Fujitsu Ten Technical report vol. 30 No. 1, Dec. 2012, pp. 3-7 (English Abstract).
Nobuyoshi Kikuma, "Adaptive Antenna Technology", Ohmsha, Ltd., Oct. 10, 2003, pp. 11-15 (Partial Translation).

* cited by examiner

*Primary Examiner* — Anh Q Tran
(74) *Attorney, Agent, or Firm* — Seed IP Law Group LLP

(57) ABSTRACT

An antenna device includes: a first sub-array antenna provided on a substrate and having a group of first antenna elements, one or more third antenna elements, and a first electrical power line through which electric power is supplied to the group of first antenna elements and the one or more third antenna elements; and a second sub-array antenna provided on the substrate and having a group of second antenna elements, the one or more third antenna elements, and a second electrical power line through which electric power is supplied to the group of second antenna elements and the one or more third antenna elements. The one or more third antenna elements are placed away from the first electrical power line and the second electrical power line.

8 Claims, 8 Drawing Sheets

ANTENNA DEVICE

BACKGROUND

1. Technical Field

The present disclosure relates to antenna devices.

2. Description of the Related Art

In wireless communication, a multiple-input multiple-output (MIMO) system having a plurality of transmitters (transmission antennas) and a plurality of receivers (reception antennas) has been known as a method for improving the communication speed and/or reliability. For example, applying the MIMO system to a radar system can improve the performance of target detection.

The radar to which the MIMO system is applied has a virtual array antenna having M×N elements (this antenna may hereinafter be referred to as a "virtual antenna array"), where M indicates the number of transmission antennas, and N indicates the number of reception antennas. In order to enhance the directional gain of each antenna, a sub-array antenna configuration having a plurality of antenna elements is used for the antenna.

For example, Japanese Unexamined Patent Application Publication (Translation of PCT Application) No. 2011-526370 (hereinafter referred to as "Patent Document 1") discloses an antenna device for a two-dimensional MIMO radar, the antenna device using the sub-array antenna configuration. According to Patent Document 1, in the antenna device, when four reception sub-array antennas are aligned with each other with an antenna gap d that is equivalent to a half of a signal wavelength, and two transmission sub-array antennas are aligned with each other with an antenna gap 4*d*, an aperture area corresponding to eight antennas can be obtained.

It is also known that grating lobes, which cause erroneous radar detection, do not occur when the antenna gap is set to a gap that is equivalent to a half of the signal wavelength, but can occur when the antenna gap is larger than a half of the signal wavelength.

SUMMARY

In the above-described related art in Patent Document 1, however, when a virtual antenna array is constructed with an antenna gap with which no grating lobes do not occur, there are cases in which it is difficult to increase the number of antenna elements in relationship to a mounting area in actual array arrangement. Thus, it has been difficult to realize an improvement in antenna performance, for example, an improvement in the directional gain or suppression or reduction of unwanted sidelobes.

One non-limiting and exemplary embodiment provides an antenna device that can realize an improvement in the antenna performance by increasing the number of antenna elements in each sub-array antenna without changing the antenna gap.

In one general aspect, the techniques disclosed here feature an antenna device that includes: a first sub-array antenna provided on a substrate and having a group of first antenna elements, one or more third antenna elements, and a first electrical power line through which electric power is supplied to the group of first antenna elements and the one or more third antenna elements; and a second sub-array antenna provided on the substrate and having a group of second antenna elements, the one or more third antenna elements, and a second electrical power line through which electric power is supplied to the group of second antenna elements and the one or more third antenna elements. The one or more third antenna elements are placed away from the first electrical power line and the second electrical power line.

One aspect of the present disclosure realizes an improvement in the antenna performance by increasing the number of antenna elements in each sub-array antenna without changing the antenna gap.

It should be noted that general or specific embodiments may be implemented as a system, an apparatus, a method, an integrated circuit, a computer program, a storage medium, or any selective combination thereof.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Embodiments of the present disclosure will be described below in detail with reference to the accompanying drawings. The embodiments described below are examples, and it is to be understood that the present disclosure is not limited by the embodiments.

Figure 1A:
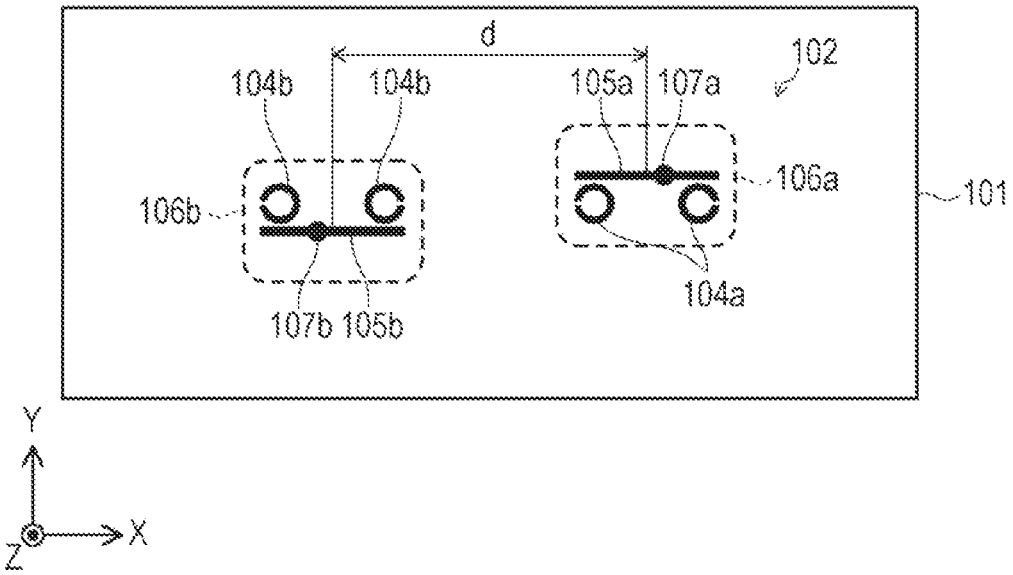
FIG. 1A is a top view illustrating one example of the configuration of an antenna device.
Figure 1B:
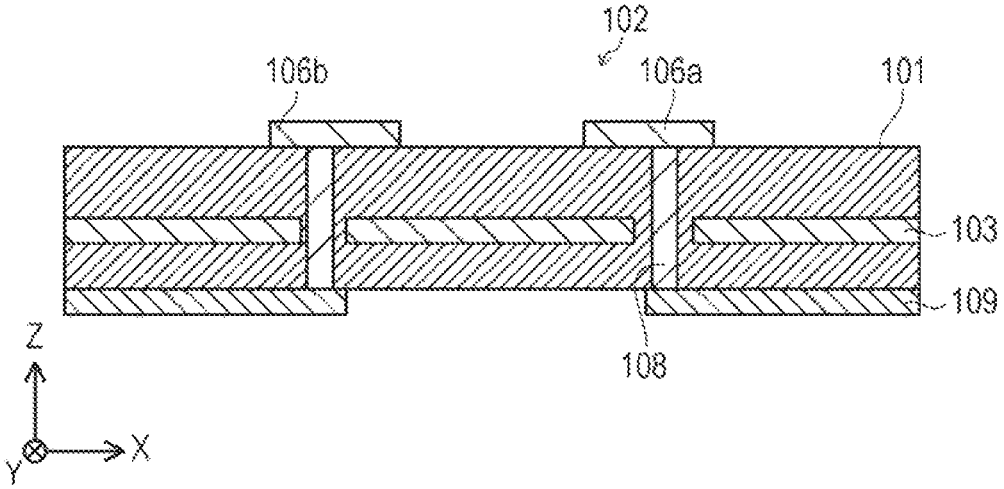
FIG. 1B is a sectional view of the antenna device illustrated in FIG. 1A.

FIG. 1A is a top view illustrating one example of the configuration of an antenna device 102. FIG. B is a sectional view of the antenna device 102 illustrated in FIG. 1A. FIGS. 1A and 1B illustrate an X-axis, a Y-axis, and a Z-axis, for convenience of description.

The antenna device 102 radiates electromagnetic waves in a positive Z-axis direction. The antenna device 102 has, for example, sub-array antennas 106*a* and 106*b*.

The sub-array antennas 106*a* and 106*b* are formed, for example, on a dielectric substrate 101. The sub-array antennas 106*a* and 106*b* are formed of, for example, metal conductors.

The sub-array antenna 106*a* has, for example, a power supply line 105*a* that receives electric power at a power supply point 107*a* and two antenna elements 104*a* that receive electric power from the power supply line 105*a*.

The sub-array antenna 106*b* has, for example, a power supply line 105*b* that receives electric power at a power supply point 107*b* and two antenna elements 104*b* that receive electric power from the power supply line 105*b*.

A middle of the two antenna elements 104*a* in the sub-array antenna 106*a* or a middle of the power supply line 105*a* may be referred to as a "center of the sub-array antenna 106*a*". A middle of the two antenna elements 104*b* in the sub-array antenna 106*b* or a middle of the power supply line 105*b* may be referred to as a "center of the sub-array antenna 106*b*". The distance between the center of the sub-array antenna 106*a* and the center of the sub-array antenna 106*b* in an X-axis direction is defined as an antenna gap d between the sub-array antennas 106*a* and 106*b*.

Electric power is supplied to the sub-array antennas 106*a* and 106*b* through back-side wiring lines 109 and power supply vias 108. Supply of electric power may be referred to as "power supply", as appropriate. Although, in this embodiment, each of the power supply points 107*a* and 107*b* and the center of the corresponding antenna elements 104*a* or 104*b* do not match each other, they may match each other depending on a system to be implemented.

For example, reflectors 103 are formed in a layer in the dielectric substrate 101. The reflectors 103 are formed as a metal layer in the dielectric substrate 101 by using a metal conductor. The reflectors 103 reflect electromagnetic waves that the sub-array antennas 106*a* and 106*b* radiate in a negative Z-axis direction. The reflectors 103 may also be referred to as a "reflective layer" or "reflection portions".

Increasing the number of antenna elements in the antenna device 102 is conceivable in order to improve an antenna radiation gain (hereinafter may be referred to as an "antenna gain"). For example, an antenna element may be added to the antenna elements 104*a* at a position about one wavelength away in each of a positive X-axis direction and a negative X-axis direction. An antenna element may also be added to the antenna elements 104*b* at a position about one wavelength away in each of the positive X-axis direction and the negative X-axis direction.

However, when an attempt is made to maintain the antenna gap d, a space where additional antenna elements can be arranged becomes insufficient between the sub-array antennas 106*a* and 106*b*. When it is difficult to add an antenna element because of insufficient space, for example, it is difficult to expect an improvement in antenna performance, such as an improvement in a directional gain of the antenna device 102 or suppression or reduction of unwanted sidelobes.

The antenna device 102 is a two-dimensional MIMO radar in which the sub-array antennas 106*a* and 106*b* are arranged in a horizontal direction (the X-axis direction). For example, in the case of a three-dimensional MIMO radar in which sub-array antennas are arranged in both the horizontal direction and a vertical direction (a Y-axis direction), a space in which additional antenna elements are arranged becomes insufficient in one of or both the horizontal direction and the vertical direction. When the space insufficiency makes it difficult to add antenna elements, it is more difficult to improve the antenna performance.

The present disclosure has been made in view of the foregoing situation and provides an antenna device that can improve the antenna performance by increasing the number of antenna elements in each sub-array antenna without changing the antenna gap.

First Embodiment

Figure 2A:
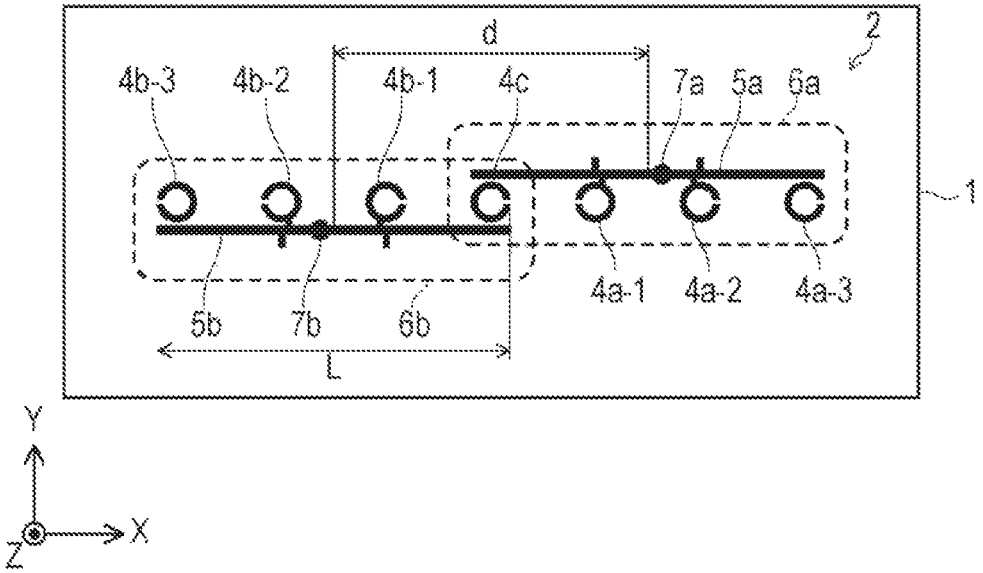
FIG. 2A is a top view illustrating one example of the configuration of an antenna device according to a first embodiment of the present disclosure.
Figure 2B:
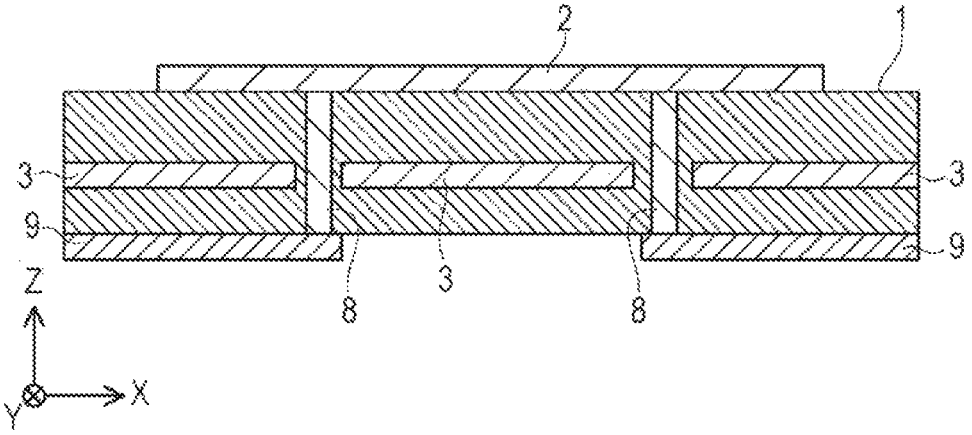
FIG. 2B is a sectional view of the antenna device illustrated in FIG. 2A.
Figure 2C:
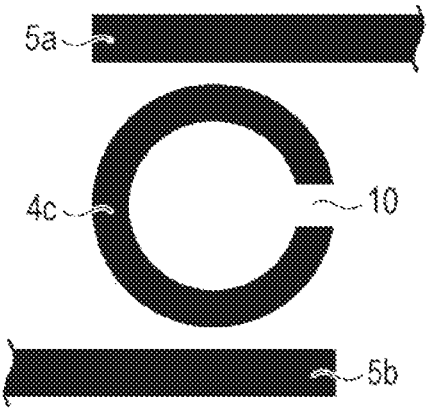
FIG. 2C is an enlarged view illustrating an antenna element in FIG. 2A.

FIG. 2A is a top view illustrating one example of the configuration of an antenna device 2 according to the present embodiment. FIG. 2B is a sectional view of the antenna device 2 illustrated in FIG. 2A. FIG. 2C is an enlarged view illustrating an antenna element 4*c* in FIG. 2A. FIG. 2A illustrates an antenna pattern of the antenna device 2.

FIGS. 2A and 2B illustrate an X-axis, a Y-axis, and a Z-axis, for convenience of description. The X-axis, the Y-axis, and the Z-axis are also illustrated in some drawings described below, as appropriate.

The antenna device 2 is formed on a dielectric substrate 1, for example, by using a metal conductor. Reflectors 3 are formed at positions that are located in a metal conductor layer in the dielectric substrate 1 and that oppose the antenna device 2. A gap between the reflectors 3 and the antenna device 2 is adjusted so that, for example, electromagnetic waves radiated in the positive Z-axis direction, which is a radiation direction of the antenna device 2, and components in the radiation direction of electromagnetic waves radiated in the negative Z-axis direction and reflected by the reflectors 3 strengthen each other. The reflectors 3 may also be referred to as a "reflective layer" or "reflective portions".

The antenna device 2 receives electric power from, for example, back-side wiring lines 9 through power supply vias 8. The power supply vias 8 supply electric power to, for example, a power supply point 7*a* of a power supply line 5*a* and a power supply point 7*b* of a power supply line 5*b*.

The antenna device 2 includes, for example, sub-array antennas 6*a* and 6*b*. The sub-array antenna 6*a* includes, for example, antenna elements 4*a*-1 to 4*a*-3 and 4*c* and the power supply line 5*a*. The sub-array antenna 6*b* includes, for example, antenna elements 4*b*-1 to 4*b*-3, the antenna element 4*c*, and the power supply line 5*b*. The antenna element 4*c* is shared by the sub-array antennas 6*a* and 6*b*.

In the description below, the sub-array antennas 6*a* and 6*b* may also be referred to as "sub-array antennas 6", as appropriate. The antenna elements 4*a*-1 to 4*a*-3, 4*b*-1 to 4*b*-3, and 4*c* may also be referred to as "antenna elements 4", as appropriate.

Since the sub-array antennas 6*a* and 6*b* function as a time-division MIMO antenna, electric powers are supplied from the power supply points 7*a* and 7*b* at different timings (in a time-division manner), rather than being supplied therefrom at the same time.

In the sub-array antenna 6*a*, the gap between the antenna element 4*c* and the antenna element 4*a*-1 and the gap between the antenna element 4*a*-2 and the antenna element 4*a*-3 are equal to each other. Thus, the center of the sub-array antenna 6*a* may be a middle of the antenna elements 4*a*-1 and 4*a*-2 in the sub-array antenna 6*a* or a middle of the power supply line 5*a*.

Also, in the sub-array antenna 6*b*, the gap between the antenna elements 4*c* and 4*b*-1 and the gap between the antenna elements 4*b*-2 and 4*b*-3 are equal to each other. Thus, the center of the sub-array antenna 6*b* may be a middle of the antenna elements 4*b*-1 and 4*b*-2 in the sub-array antenna 6*b* or a middle of the power supply line 5*b*.

The distance between the center of the sub-array antenna 6*a* and the center of the sub-array antenna 6*b* in the X-axis direction is defined as an antenna gap d between the sub-array antennas 6*a* and 6*b*.

The antenna gap d is, for example, smaller than L, where L indicates the size (the length L in the X-axis direction) of each of the sub-array antennas 6*a* and 6*b*. The position of the "power supply point" set on each "power supply line" and the center position of the "power supply line" do not necessarily match each other. Each "power supply point" is set, for example, at a position at which electrical currents having the same phase are supplied to the "antenna elements" arranged along the corresponding "power supply line". Matters related to positional settings of the "power supply points" are not limited to those illustrated in FIG. 2A and also apply to other drawings that are referred to herein.

The power supply line 5*a* is arranged, for example, on the dielectric substrate 1 along the X-axis. The power supply line 5*a* receives electric power at the power supply point 7*a*. The power supply line 5*b* is arranged, for example, on the dielectric substrate 1 along the X-axis. The power supply line 5*b* receives electric power at the power supply point 7*b*.

Each of the antenna elements 4*a*-1 to 4*a*-3, 4*b*-1 to 4*b*-3, and 4*c* is a looped shape (which may also be referred to as a "circular-ring shape" or "doughnut shape") element having a notch 10. The orientation of the notch 10 in each of the antenna elements 4*a*-2, 4*a*-3, 4*b*-1, and 4*c* is, for example, the positive X-axis direction. The orientation of the notch 10 in each of the antenna elements 4*a*-1, 4*b*-2, and 4*b*-3 is, for example, the negative X-axis direction. The orientations of the notches 10 in the antenna device 2 are merely exemplary, and the present disclosure is not limited thereto. For example, the orientations of the notches 10 may be set according to antenna characteristics.

The antenna elements 4*a*-1 to 4*a*-3 are arranged, for example, along the power supply line 5*a*. Of the antenna elements 4*a*-1 to 4*a*-3, the antenna elements 4*a*-1 and 4*a*-2 arranged at positions relatively close to the power supply point 7*a* are connected, for example, to the power supply line 5*a* via a metal conductor pattern to receive electric power from the power supply line 5*a*. Of the antenna elements 4*a*-1 to 4*a*-3, the antenna element 4*a*-3 arranged at a position relatively far from the power supply point 7*a* is, for example, not connected to the power supply line 5*a* via a metal conductor pattern and couples with the power supply line 5*a* via an electromagnetic field (i.e., performs electromagnetic-field coupling) to receive electric power from the power supply line 5*a*. This makes it possible to adjust electric power to be supplied to each antenna element 4.

The antenna elements 4*b*-1 to 4*b*-3 are arranged, for example, along the power supply line 5*b*. Of the antenna elements 4*b*-1 to 4*b*-3, the antenna elements 4*b*-1 and 4*b*-2 arranged at positions relatively close to the power supply point 7*b* are connected to, for example, the power supply line 5*b* via a metal conductor pattern to receive electric power from the power supply line 5*b*. Of the antenna elements 4*b*-1 to 4*b*-3, the antenna element 4*b*-3 arranged at a position relatively far from the power supply point 7*b* is, for example, not connected to the power supply line 5*b* via a metal conductor pattern and couples with the power supply line 5*b* via an electromagnetic field to receive electric power from the power supply line 5*b*. This makes it possible to adjust electric power to be supplied to each antenna element 4.

The antenna element 4*c* is arranged, for example, along the power supply lines 5*a* and 5*b* and between the antenna elements 4*a*-1 and 4*b*-1. The antenna element 4*c* couples, for example, with the power supply line 5*a* via an electromagnetic field to receive electric power from the power supply line 5*a*. Also, the antenna element 4*c* couples with the power supply line 5*b*, for example, via an electromagnetic field to receive electric power from the power supply line 5*b*. However, the antenna element 4*c* does not receive electric power from both the power supply lines 5*a* and 5*b* at the same timing. The antenna element 4*c* is not connected to the power supply lines 5*a* and 5*b* via a metal conductor pattern. The antenna element 4*c* is placed away from the power supply lines 5*a* and 5*b*.

The antenna elements 4*a*-1 and 4*a*-2 physically contact the power supply line 5*a* via a metal conductor pattern in order to increase the degree of coupling, and the antenna elements 4*a*-3 and 4*c* do not contact the power supply line 5*a* via a metal conductor pattern. With this configuration, electric power supplied from the power supply line 5*a* to the antenna elements 4*a*-3 and 4*c* becomes smaller than electric power supplied to the antenna elements 4*a*-1 and 4*a*-2.

The antenna elements 4*b*-1 and 4*b*-2 physically contact the power supply line 5*b* via a metal conductor pattern in order to increase the degree of coupling, and the antenna elements 4*b*-3 and 4*c* do not contact the power supply line 5*b* via a metal conductor pattern. With this configuration, electric power supplied from the power supply line 5*b* to the antenna elements 4*b*-3 and 4*c* becomes smaller than electric power supplied to the antenna elements 4*b*-1 and 4*b*-2.

As described above, the antenna element 4*c* is placed away from the power supply lines 5*a* and 5*b* and does not physically contact the power supply lines 5*a* and 5*b* via a metal conductor pattern. In addition, electric power supplied to the antenna element 4*c* is smaller than electric power supplied to the antenna elements 4*a*-1, 4*a*-2, 4*b*-1, and 4*b*-2. With this configuration, for example, when the sub-array antenna 6*a* is performing an operation for radiating electromagnetic waves, electric power that leaks to the sub-array antenna 6*b* can be suppressed or reduced. Also, for example, when the sub-array antenna 6*b* is performing an operation for radiating electromagnetic waves, electric power that leaks to the sub-array antenna 6*a* can be suppressed or reduced. For example, when the sub-array antenna 6*a* is performing an operation for radiating electromagnetic waves, the sub-array antenna 6*b* does not perform an operation for radiating electromagnetic waves.

It is desirable that electric power supplied to the antenna element 4*c* be adjusted to be smaller than or equal to electric power supplied to the antenna elements 4*a*-1 to 4*a*-3 and 4*b*-1 to 4*b*-3.

Such adjustment of the electric power to be supplied makes it possible to suppress or reduce electric power that leaks to the sub-array antenna 6*b* when electric power is supplied to the sub-array antenna 6*a*. Also, when electric power is supplied to the sub-array antenna 6*b*, electric power that leaks to the sub-array antenna 6*a* can be suppressed or reduced.

For example, for the sub-array antennas 6*a* and 6*b* each being constituted by four antenna elements, it is desirable that electric power supplied to the antenna element 4*c* through the power supply line 5*a* be adjusted to be 20% or less of electric power supplied from the power supply point 7*a* to the power supply line 5*a*. It is also desirable that electric power supplied to the antenna element 4*c* through the power supply line 5*b* be adjusted to be 20% or less of electric power supplied from the power supply point 7*b* to the power supply line 5*b*.

Also, since the sub-array antennas 6*a* and 6*b* function as a time-division MIMO antenna, electric powers are supplied from the power supply points 7*a* and 7*b* to the antenna element 4*c* at different timings (in a time-division manner), rather than being supplied therefrom at the same time. Thus, the antenna element 4*c* operates as an antenna element for the sub-array antenna 6*a* when electric power is supplied from the power supply point 7*a* and operates as an antenna element for the sub-array antenna 6*b* when electric power is supplied from the power supply point 7*b*.

Next, a description will be given of a radiation characteristic of the antenna device 2 according to the first embodiment.

Figure 3:
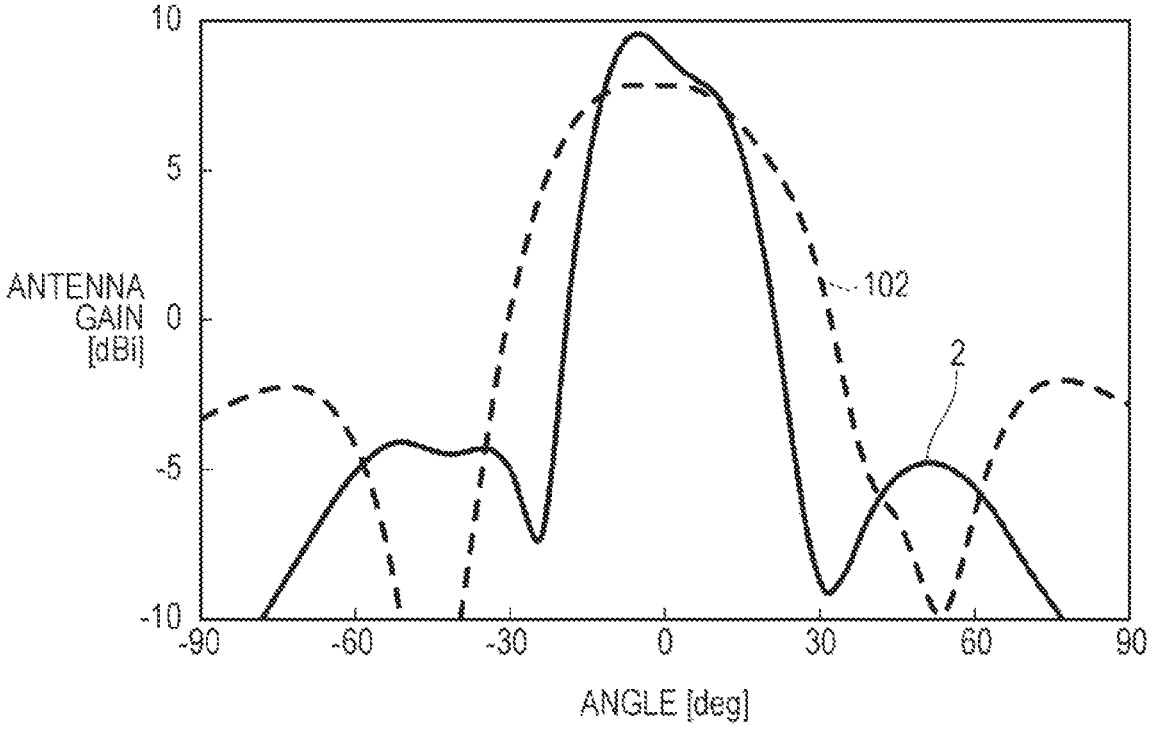
FIG. 3 is a graph illustrating a radiation characteristic of the antenna device according to the first embodiment of the present disclosure.

FIG. 3 is a graph illustrating a radiation characteristic of the antenna device 2 according to the first embodiment. FIG. 3 also illustrates, as a comparative example, a radiation characteristic of the antenna device 102 illustrated in FIGS. 1A and 1B. The radiation characteristics illustrated in FIG. 3 are radiation characteristics of 79 gigahertz (GHz) electromagnetic waves radiated in the positive Z-axis direction, the radiation characteristics being determined using electromagnetic field simulation. In FIG. 3, the horizontal axis represents a radiation angle (in degrees [deg]) of electromagnetic waves, and the vertical axis represents an antenna gain (in decibels isotropic [dBi]). In FIG. 3, the radiation angle on the horizontal axis is an angle relative to the Z-axis in a plane parallel to an X-Z plane in FIGS. 1A and 2A, where the Z-axis is assumed to be 0 degree. Also, electric power supplied to the antenna element 4*c* in the antenna device 2 is adjusted to 12% of electric power supplied to the power supply points 7*a* and 7*b*.

As illustrated in FIG. 3, the maximum value of the antenna gain of the antenna device 2 is about 1.8 dB higher than the maximum value of the antenna gain of the antenna device 102. Sidelobes of the antenna device 2 can be reduced by about 2 to 3 dB, compared with the antenna device 102.

In the antenna device 2 according to the first embodiment, the sub-array antennas 6*a* and 6*b* share the antenna element 4*c* to thereby maintain the antenna gap d, thus making it possible to increase the number of antenna elements in each sub-array antenna from two to four. Thus, it is possible to improve the antenna gain (the directional gain), to suppress or reduced unwanted sidelobes, and to improve the antenna performance.

The antenna device 2 is an example in which the antenna elements 4 are arranged in one line along the X-axis. The present disclosure is not limited to this example. Next, a description will be given of an example in which antenna devices are arranged in the Y-axis direction and are connected in parallel.

Figure 4:
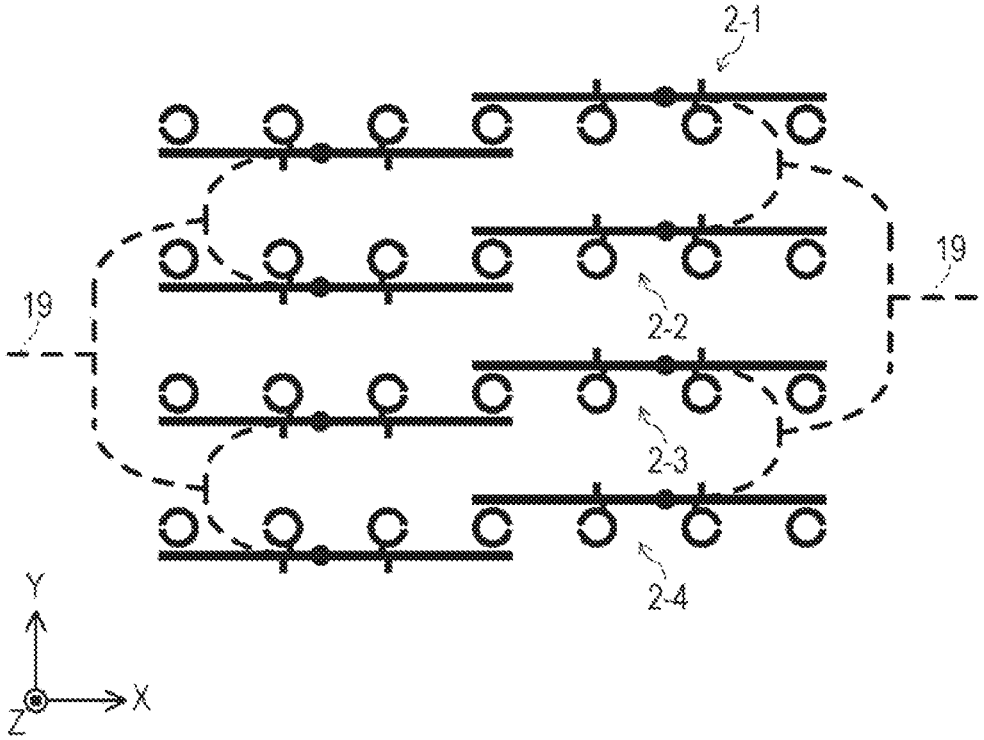
FIG. 4 is a top view illustrating a first modification of the configuration of the antenna device according to the first embodiment of the present disclosure.

FIG. 4 is a top view illustrating a first modification of the configuration of the antenna device according to the first embodiment. An antenna device illustrated in FIG. 4 has a configuration in which four antenna devices 2 (antenna devices 2-1 to 2-4) are arranged in the Y-axis direction. Electric power is supplied to power supply points 7*a* and 7*b* in the antenna devices 2 through back-side wiring lines 19 and power supply vias (not illustrated).

This configuration can improve the antenna gain (the directional gain) in a vertical direction (a Y-axis direction) in addition to the horizontal direction (the X-axis direction), can suppress or reduce unwanted sidelobes, and can improve the antenna performance. This configuration can also reduce not only a half-value angle in the horizontal direction (the X-axis direction) of an electromagnetic-wave main beam that the antenna device radiates in the positive Z-axis direction but also a half-value angle in the vertical direction (the Y-axis direction).

The operating frequency noted above in the first embodiment is one example, and the present disclosure is not limited thereto. The antenna device in the present disclosure may also be operated in a high frequency band of 10 GHz or higher including a millimeter wave band and a terahertz band.

The description in the first embodiment has been given of an example in which the number of sub-array antennas 6 is two. The present disclosure is not limited to the example. The number of sub-array antennas 6 may be three or more. For example, when a third sub-array antenna 6*c* (not illustrated) is provided on the antenna device 2 in the positive X-axis direction relative to the sub-array antenna 6*a*, the sub-array antenna 6*a* and the third sub-array antenna 6*c* share the antenna element 4*a*-3.

The above description in the first embodiment has been given of an example in which the number of antenna elements 4 shared by the two sub-array antennas 6 is 1. The present disclosure is not limited to this example. The number of antenna elements 4 shared by the two sub-array antennas 6 may be two or more. For example, when each sub-array antenna 6 is constituted by eight antenna elements 4, and two sub-array antennas 6 share two antenna elements 4, the two sub-array antennas 6 are constituted by 14 antenna elements 4.

Also, the description in the first embodiment has been given of an example in which each antenna element 4 has a looped shape with the notch 10. The present disclosure is not limited to the example. Each antenna element 4 may have a shape, such as a rectangular or quadrangular shape, that is different from the looped shape.

Figure 5:
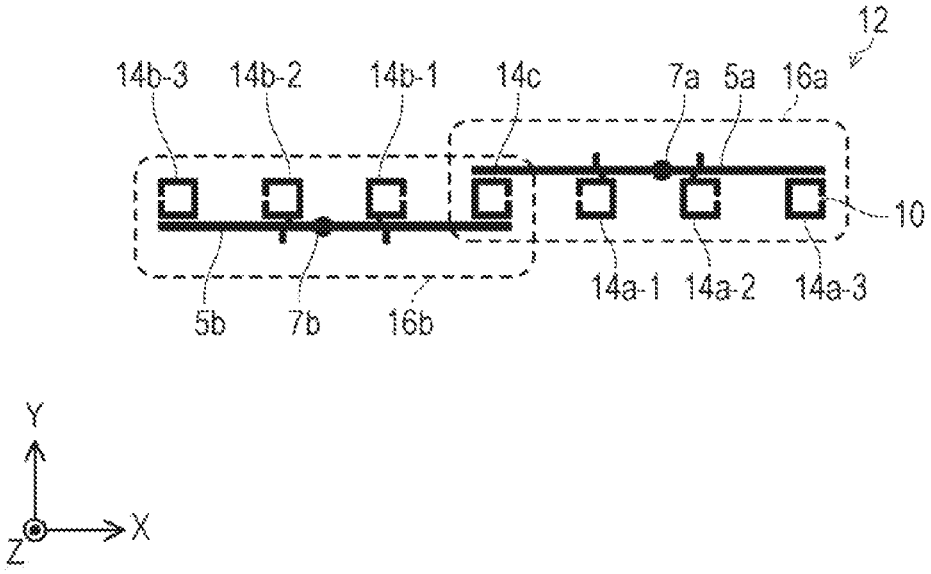
FIG. 5 is a top view illustrating a second modification of the configuration of the antenna device according to the first embodiment of the present disclosure.

FIG. 5 is a top view illustrating a second modification of the configuration of the antenna device according to the first embodiment. In an antenna device 12 illustrated in FIG. 5, the looped shape antenna elements 4 in the antenna device 2 is replaced with rectangular antenna elements 14 (antenna elements 14*a*-1 to 14*a*-3, 14*b*-1 to 14*b*-3, and 14*c*).

In the antenna device 12 illustrated in FIG. 5, sub-array antennas 16*a* and 16*b* share the antenna element 14*c* to thereby maintain an antenna gap as in the antenna device 2, thus making it possible to increase the number of antenna elements in each sub-array antenna from two to four. Thus, it is possible to improve the antenna gain (the directional gain), to suppress or reduce unwanted sidelobes, and to improve the antenna performance.

Although, in the antenna device 12 illustrated in FIG. 5, an example in which the two sub-array antennas 16*a* and 16*b* share the antenna element 14*c* has been described, the present disclosure is not limited thereto. For example, even when three or more sub-array antennas are arranged along the X-axis, and adjacent sub-array antennas of the three or more sub-array antennas share an antenna element, advantages that are analogous to those described above can be obtained.

Second Embodiment

The description in the first embodiment has been given of an example of an antenna device in which antenna elements are arranged on a straight line (one-dimensionally) along each power supply line that extends in one direction (the X-axis direction). In a second embodiment, a description will be given of an example of an antenna device in which antenna elements are arranged in a two-dimensional manner (two-dimensionally).

Figure 6:
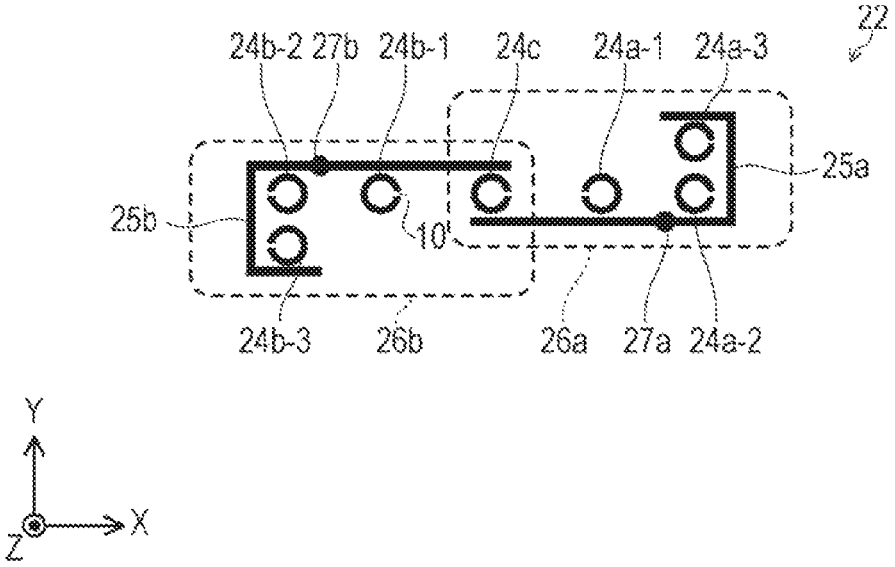
FIG. 6 is a top view illustrating one example of the configuration of an antenna device according to a second embodiment.

FIG. 6 is a top view illustrating one example of the configuration of an antenna device 22 according to the second embodiment.

In the antenna device 22, the arrangements of some of the antenna elements in the antenna device 2 have been changed. Since power supply vias and back-side wiring lines through which electric power is supplied to the antenna device 22 are the same as or similar to the power supply vias 8 and the back-side wiring lines 9 in the antenna device 2 described above, they are not illustrated. Since a dielectric substrate on which the antenna device 22 is formed and reflectors provided in a layer in the dielectric substrate are also the same as or similar to those in the antenna device 2 described above, they are not illustrated.

The antenna device 22 includes, for example, sub-array antennas 26*a* and 26*b*. The sub-array antenna 26*a* includes antenna elements 24*a*-1 to 24*a*-3 and 24*c* and a power supply line 25*a*. The sub-array antenna 26*b* includes antenna elements 24*b*-1 to 24*b*-3, the antenna element 24*c*, and a power supply line 25*b*. The antenna element 24*c* is shared by the sub-array antennas 26*a* and 26*b*.

In the description below, the antenna elements 24*a*-1 to 24*a*-3 may be referred to as "antenna elements 24*a*", as appropriate. The antenna elements 24*b*-1 to 24*b*-3 may also be referred to as "antenna elements 24*b*", as appropriate.

Since the sub-array antennas 26*a* and 26*b* function as a time-division MIMO antenna, electric powers are supplied from the power supply points 27*a* and 27*b* at different timings (in a time-division manner), rather than being supplied therefrom at the same time.

Each of the antenna elements 24*a*-1 to 24*a*-3, 24*b*-1 to 24*b*-3, and 24*c* is a looped-shape element having a notch 10. The orientation of the notch 10 in each of the antenna elements 24*a*-2, 24*a*-3, 24*b*-1, and 24*c* is the positive X-axis direction. The orientation of the notch 10 in each of the antenna elements 24*a*-1, 24*b*-2, and 24*b*-3 is the negative X-axis direction. The orientations of the notches 10 in the antenna device 22 are merely exemplary, and the present disclosure is not limited thereto. For example, the orientations of the notches 10 may be set according to antenna characteristics.

The antenna elements 24*a*-1, 24*a*-2, 24*b*-1, 24*b*-2, and 24*c* are arranged on a straight line along the X-axis direction. The antenna element 24*a*-3 is arranged in alignment with the antenna element 24*a*-2 along the Y-axis direction and in the positive Y-axis direction relative to the antenna element 24*a*-2. The antenna element 24*b*-3 is arranged in alignment with the antenna element 24*b*-2 along the Y-axis direction and in the negative Y-axis direction relative to the antenna element 24*b*-2.

The antenna elements 24*a*-1 to 24*a*-3 are arranged along the power supply line 25*a*. Part of the power supply line 25*a* which extends in the positive X-axis direction relative to the power supply point 27*a* is formed so as to bend in the positive Y-axis direction in accordance with the arrangement of the antenna element 24*a*-3 and so as to lie along the antenna element 24*a*-3.

The state of connection between each of the antenna elements 24*a*-1 to 24*a*-3 and the power supply line 25*a* and a positional relationship therebetween may also be determined, for example, depending on a system that uses the antenna device 22 in the second embodiment.

As in the first embodiment, electric power to be received by the antenna elements 24*a* can be adjusted depending on a combination of a positional relationship between the antenna element(s) 24*a* connected to the power supply line 25*a* via a metal conductor pattern and the power supply point 27*a* and a positional relationship between the antenna element(s) 24*a* that couple(s) with the power supply line 25*a* via an electromagnetic field and the power supply point 27*a*.

The antenna elements 24*b*-1 to 24*b*-3 are arranged along the power supply line 25*b*. Part of the power supply line 25*b* which extends in the negative X-axis direction relative to the power supply point 27*b* is formed so as to bend in the negative Y-axis direction in accordance with the arrangement of the antenna element 24*b*-3 and so as to lie along the antenna element 24*b*-3.

The state of connection between each of the antenna elements 24*b*-1 to 24*b*-3 and the power supply line 25*b* and a positional relationship therebetween may also be determined, for example, depending on a system that uses the antenna device 22 in the second embodiment.

As in the first embodiment, electric power to be received by the antenna elements 24*b* can be adjusted depending on a combination of a positional relationship between the antenna element(s) 24*b* connected to the power supply line 25*b* via a metal conductor pattern and the power supply point 27*b* and a positional relationship between the antenna element(s) 24*b* that couple(s) with the power supply line 25*b* via an electromagnetic field and the power supply point 27*b*.

The antenna element 24*c* is arranged, for example, along the power supply lines 25*a* and 25*b* and between the antenna elements 24*a*-1 and 24*b*-1. The antenna element 24*c* couples with, for example, the power supply line 25*a* via an electromagnetic field to receive electric power from the power supply line 25*a*. The antenna element 24*c* also couples with, for example, the power supply line 25*b* via an electromagnetic field to receive electric power from the power supply line 25*b*. However, the antenna element 24*c* does not receive electric power from both the power supply lines 25*a* and 25*b* at the same timing. The antenna element 24*c* is not connected to the power supply lines 25*a* and 25*b* via a metal conductor pattern. The antenna element 24*c* is placed away from the power supply lines 25*a* and 25*b*.

The sub-array antenna 26*a* is designed such that electric power supplied from the power supply line 25*a* to the antenna element 24*c* is smaller than or equal to electric power supplied to the antenna elements 24*a*-1, 24*a*-2, and 24*a*-3.

The sub-array antennas 26*b* is also designed such that electric power supplied from the power supply line 25*b* to the antenna element 24*c* is smaller than or equal to electric power supplied to the antenna elements 24*b*-1, 24*b*-2, and 24*b*-3.

Thus, the sub-array antennas 26*a* and 26*b* operates upon receiving power supplied in a time-division manner, as in the first embodiment, and the antenna element 24*c*, which is placed away from the power supply lines 25*a* and 25*b*, couples therewith via an electromagnetic field, thereby making it possible to suppress or reduce electric power that leaks to the sub-array antenna 26*b*, for example, when the sub-array antenna 26*a* is performing an operation for radiating electromagnetic waves. Also, for example, when the sub-array antenna 26*b* is performing an operation for radiating electromagnetic waves, it is possible to suppress or reduce electric power that leaks to the sub-array antenna 26*a*.

It is desirable that electric power supplied to the antenna element 24*c* be adjusted to be smaller than or equal to electric power supplied to the antenna elements 24*a*-1 to 24*a*-3 and 24*b*-1 to 24*b*-3.

Such adjustment of the electric power to be supplied makes it possible to suppress or reduce electric power that leaks to the sub-array antenna 26*b* when electric power is supplied to the sub-array antenna 26*a*. Also, when electric power is supplied to the sub-array antenna 26*b*, electric power that leaks to the sub-array antenna 26*a* can be suppressed or reduced.

Also, as in the first embodiment, since the sub-array antennas 26*a* and 26*b* function as a time-division MIMO antenna, electric powers are supplied from the power supply points 27*a* and 27*b* to the antenna element 24*c* at different timings (in a time-division manner), rather than being supplied therefrom at the same time. Thus, the antenna element 24*c* operates as an antenna element for the sub-array antenna 26*a* when electric power is supplied from the power supply point 27*a* and operates as an antenna element for the sub-array antenna 26*b* when electric power is supplied from the power supply point 27*b*.

In the antenna device 22 according to the second embodiment, the sub-array antennas 26*a* and 26*b* share the antenna element 24*c* to thereby maintain the antenna gap, thus making it possible to increase the number of antenna elements in each sub-array antenna. Thus, it is possible to improve the antenna gain (the directional gain), to suppress or reduce unwanted sidelobes, and to improve the antenna performance.

In the antenna device 22 according to the second embodiment, the antenna elements 24*a*-1, 24*a*-2, 24*b*-1, 24*b*-2, and 24*c* are arranged in the horizontal direction (the X-axis direction), and the antenna elements 24*a*-3 and 24*b*-3 are arranged in a direction orthogonal (i.e., the Y-axis direction) to the antenna elements arranged in the horizontal direction. This configuration makes it possible to reduce not only a half-value angle in the horizontal direction (the X-axis direction) of an electromagnetic-wave main beam that the antenna device 22 radiates in the positive Z-axis direction but also a half-value angle in the vertical direction (the Y-axis direction).

FIG. 6 illustrates one example of an antenna device in which antenna elements are arranged in a two-dimensional manner (two-dimensionally), and the present disclosure is not limited thereto. A modification of the antenna device in which antenna elements are arranged in a two-dimensional manner (two-dimensionally) will be described next with reference to FIGS. 7A to 7C.

Figure 7A:
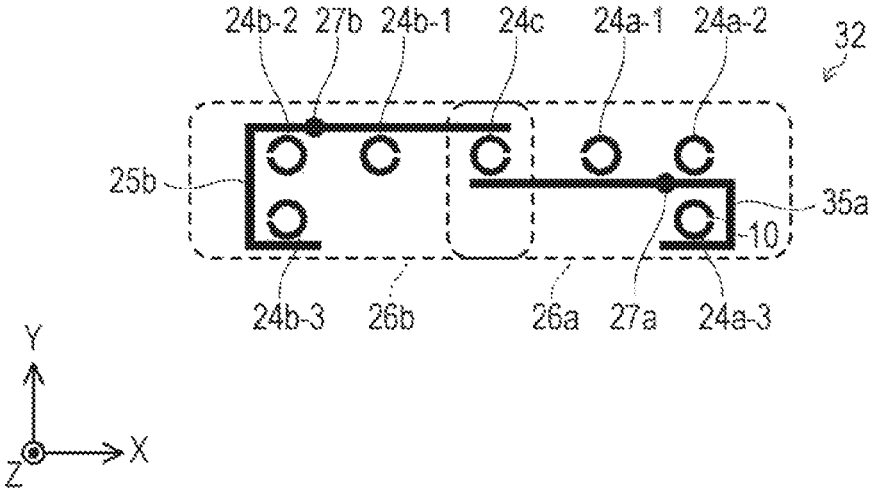
FIG. 7A is a top view illustrating a first modification of the antenna device according to the second embodiment of the present disclosure.
Figure 7B:
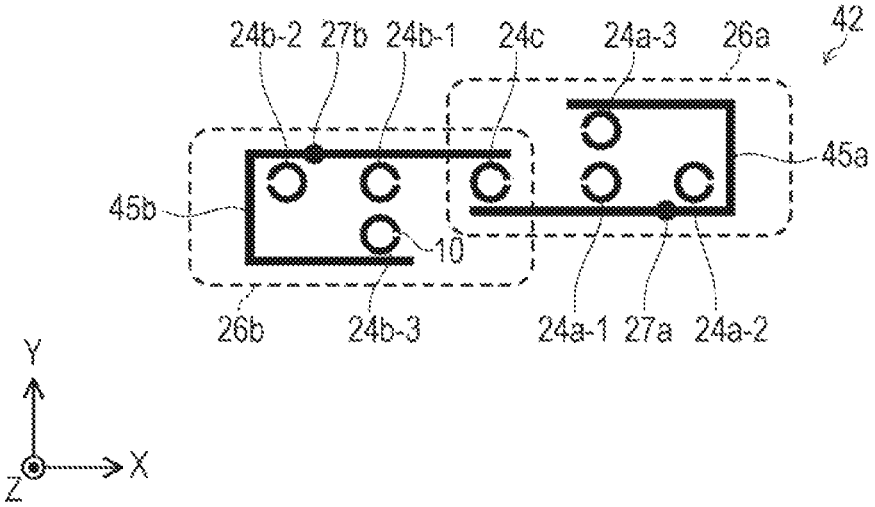
FIG. 7B is a top view illustrating a second modification of the antenna device according to the second embodiment of the present disclosure.
Figure 7C:
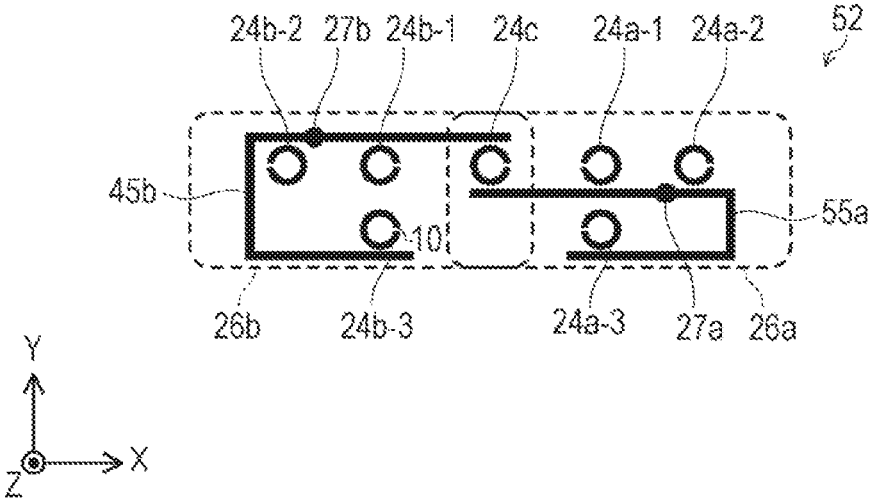
FIG. 7C is a top view illustrating a third modification of the antenna device according to the second embodiment of the present disclosure.

FIG. 7A is a top view illustrating a first modification of the antenna device according to the second embodiment. FIG. 7B is a top view illustrating a second modification of the antenna device according to the second embodiment. FIG. 7C is a top view illustrating a third modification of the antenna device according to the second embodiment. In FIGS. 7A to 7C, constituent elements that are the same as or similar to those in FIG. 6 are denoted by the same reference numerals, and descriptions thereof are not given hereinafter.

An antenna device 32 illustrated in FIG. 7A differs in the position of the antenna element 24*a*-3 from the antenna device 22 illustrated in FIG. 6.

The antenna element 24*a*-3 in the antenna device 32 is arranged in alignment with the antenna element 24*a*-2 along the Y-axis direction and in the negative Y-axis direction relative to the antenna element 24*a*-2. Part of a power supply line 35*a* which extends in the positive X-axis direction relative to the power supply point 27*a* is formed so as to bend in the negative Y-axis direction in accordance with the arrangement of the antenna element 24*a*-3 and so as to lie along the antenna element 24*a*-3.

An antenna device 42 illustrated in FIG. 7B differs in the positions of the antenna elements 24*a*-3 and 24*b*-3 from the antenna device 22 in FIG. 6.

The antenna element 24*a*-3 in the antenna device 42 is arranged in alignment with the antenna element 24*a*-1 along the Y-axis direction and in the positive Y-axis direction relative to the antenna element 24*a*-1. Part of a power supply line 45*a* which extends in the positive X-axis direction relative to the power supply point 27*a* is formed so as to bend in the positive Y-axis direction in accordance with the arrangement of the antenna element 24*a*-3 and so as to lie along the antenna element 24*a*-3.

The antenna element 24*b*-3 in the antenna device 42 is arranged in alignment with the antenna element 24*b*-1 along the Y-axis direction and in the negative Y-axis direction relative to the antenna element 24*b*-1. Part of a power supply line 45*b* which extends in the negative X-axis direction relative to the power supply point 27*b* is formed so as to bend in the negative Y-axis direction in accordance with the arrangement of the antenna element 24*b*-3 and so as to lie along the antenna element 24*b*-3.

The notch 10 of the antenna element 24*a*-3 is provided in the negative X-axis direction. The notch 10 of the antenna element 24*b*-3 is provided in the positive X-axis direction.

An antenna device 52 illustrated in FIG. 7C in the position of the antenna element 24*a*-3 differs from the antenna device 42 illustrated in FIG. 7B.

The antenna element 24*a*-3 in the antenna device 52 is arranged in alignment with the antenna element 24*a*-1 along the Y-axis direction and in the negative Y-axis direction relative to the antenna element 24*a*-1. Part of a power supply line 55*a* which extends in the positive X-axis direction relative to the power supply point 27*a* is formed so as to bend in the negative Y-axis direction in accordance with the arrangement of the antenna element 24*a*-3 and so as to lie along the antenna element 24*a*-3.

This configuration makes it possible to reduce not only a half-value angle in the horizontal direction (the X-axis direction) of an electromagnetic-wave main beam that the antenna device radiates in the positive Z-axis direction but also a half-value angle in the vertical direction (the Y-axis direction).

The antenna devices illustrated in FIGS. 6 and 7A to 7C form respective beam patterns that are different from each other. For example, in order to obtain a desired beam pattern, an antenna-element planar arrangement can be selected from antenna-element planar arrangements including those in FIGS. 6 and 7A to 7C, as appropriate, based on design conditions of an antenna device.

The orientations of the notches 10 in the antenna elements in the antenna devices illustrated in FIGS. 6 and 7A to 7C are merely exemplary, and the present disclosure is not limited thereto. For example, the orientations of the notches 10 may also be set according to antenna characteristics.

Two or more of the antenna devices described above in the second embodiment may be arranged in the X-axis direction or may be arranged in the Y-axis direction.

Third Embodiment

The description in the first embodiment has been given of an example in which two sub-array antennas share one antenna element. In a third embodiment, a description will be given of an example in which two sub-array antennas share a plurality of antenna elements.

Figure 8:
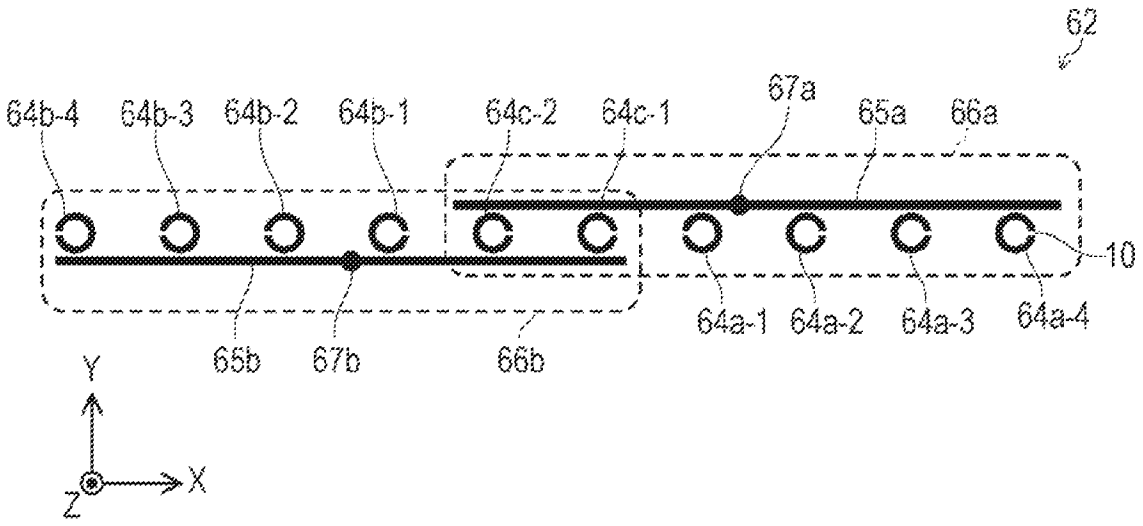
FIG. 8 is a top view illustrating one example of the configuration of an antenna device according to a third embodiment of the present disclosure.

FIG. 8 is a top view illustrating one example of the configuration of an antenna device 62 according to the third embodiment. In FIG. 8, antenna elements are linearly arranged, two sub-array antennas share two antenna elements thereof. Even when the number of antenna elements that are shared is three or more, the antenna elements can be linearly arranged, as in FIG. 8.

In the antenna device 62 illustrated in FIG. 8, since two antenna elements that are shared are provided, it is possible to improve the antenna gain by increasing the number of antenna elements in each sub-array antenna from four to six, while maintaining the gap between the sub-array antennas. In addition, it is possible to improve a working rate of elements in the antenna that operates as a time-division MIMO antenna.

The antenna device 62 includes, for example, sub-array antennas 66*a* and 66*b*. The sub-array antenna 66*a* includes antenna elements 64*a*-1 to 64*a*-4, 64*c*-1, and 64*c*-2, and a power supply line 65*a*. The sub-array antenna 66*b* includes antenna elements 64*b*-1 to 64*b*-4, the antenna elements 64*c*-1 and 64*c*-2, and a power supply line 65*b*. The antenna elements 64*c*-1 and 64*c*-2 are antenna elements shared by the sub-array antennas 66*a* and 66*b*.

In the description below, the antenna elements 64*a*-1 to 64*a*-4 may be referred to as "antenna elements 64*a*", as appropriate. The antenna elements 64*b*-1 to 64*b*-4 may also be referred to as "antenna elements 64*b*", as appropriate. The antenna elements 64*c*-1 and 64*c*-2 may also be referred to as "antenna elements 64*c*", as appropriate.

Since the sub-array antennas 66*a* and 66*b* function as a time-division MIMO antenna, electric powers are supplied from the power supply points 67*a* and 67*b* at different timings (in a time-division manner), rather than being supplied therefrom at the same time.

The antenna elements 64*a*-1 to 64*a*-4, 64*b*-1 to 64*b*-4, 64*c*-1, and 64*c*-2 are arranged on a straight line along the X-axis direction. The orientations of the notches 10 in the antenna elements in the antenna device 62 are merely exemplary, and the present disclosure is not limited thereto. For example, the orientations of the notches 10 may also be set according to antenna characteristics.

The antenna elements 64*a*-1 to 64*a*-4 are arranged along the power supply line 65*a*. The antenna elements 64*b*-1 to 64*b*-4 are arranged along the power supply line 65*b*.

The state of connection between each of the antenna elements 64*a*-1 to 64*a*-4 and the power supply line 65*a* and a positional relationship therebetween may also be determined, for example, depending on a system that uses the antenna device 62 in the third embodiment.

As in the first embodiment, electric power to be received by the antenna elements 64*a* can be adjusted depending on a combination of a positional relationship between the antenna element(s) 64*a* connected to the power supply line 65*a* via a metal conductor pattern and the power supply point 67*a* and a positional relationship between the antenna element(s) 64*a* that couple(s) with the power supply line 65*a* via an electromagnetic field and the power supply point 67*a*.

The state of connection between each of the antenna elements 64*b*-1 to 64*b*-4 and the power supply line 65*b* and a positional relationship therebetween may also be determined, for example, depending on a system that uses the antenna device 62 in the third embodiment.

As in the first embodiment, electric power to be received by the antenna elements 64*b* can be adjusted depending on a combination of a positional relationship between the antenna element(s) 64*b* connected to the power supply line 65*b* via a metal conductor pattern and the power supply point 67*b* and a positional relationship between the antenna element(s) 64*b* that couple(s) with the power supply line 65*b* via an electromagnetic field and the power supply point 67*b*.

The antenna elements 64*c* are arranged, for example, between the antenna elements 64*a*-1 and 64*b*-1 and along the power supply lines 65*a* and 65*b*. The antenna elements 64*c* couple with, for example, the power supply line 65*a* via an electromagnetic field to receive electric power from the power supply line 65*a*. The antenna elements 64*c* also couple with, for example, the power supply line 65*b* via an electromagnetic field to receive electric power from the power supply line 65*b*. The antenna elements 64*c* are not connected to the power supply lines 65*a* and 65*b* via a metal conductor pattern. The antenna elements 64*c* are placed away from the power supply lines 65*a* and 65*b*.

The sub-array antenna 66*a* is designed such that electric power supplied from the antenna elements 64*c* to the power supply line 65*a* is smaller than or equal to electric power supplied to the antenna element 64*a*.

The sub-array antenna 66*b* is also designed such that electric power supplied from the power supply line 65*b* to the antenna elements 64*c* is smaller than or equal to electric power supplied to the antenna element 64*b*.

Also, as in the first embodiment, since the sub-array antennas 66*a* and 66*b* function as a time-division MIMO antenna, electric powers are supplied from the power supply points 67*a* and 67*b* to the antenna elements 64*c* at different timings (in a time-division manner), rather than being supplied therefrom at the same time. Thus, the antenna elements 64*c* operate as antenna elements for the sub-array antenna 66*a* when electric power is supplied from the power supply point 67*a* and operate as antenna elements for the sub-array antenna 66*b* when electric power is supplied from the power supply point 67*b*.

In the antenna device 62, the number of antenna elements that are shared may also be increased in the vertical direction (the Y-axis direction), as in FIG. 4. In such a case, even when the number of antenna elements in each sub-array antenna is increased to six in order to improve the antenna gain, the antenna gaps can be reduced more effectively.

Figure 9:
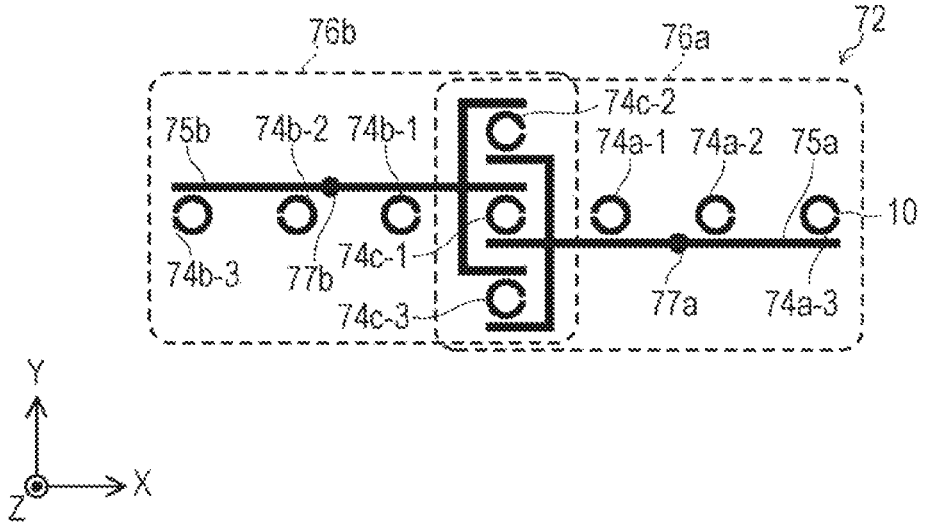
FIG. 9 is a top view illustrating another example of the configuration of the antenna device according to the third embodiment of the present disclosure.

FIG. 9 is a top view illustrating another example of the configuration of the antenna device 62 according to the third embodiment. In FIG. 9, three antenna elements are shared, and the antenna elements that are shared are arranged orthogonal to antenna elements that are not shared. That is, when the number of antenna elements that are shared is an odd number that is larger than or equal to 3, the antenna elements that are shared can be arranged orthogonal to the antenna elements that are not shared, unlike the configurations illustrated in FIGS. 2A and 8.

An antenna device 72 is an example of an antenna device in which the number of antenna elements that are shared by two sub-array antennas is increased to three, with respect to the antenna device 2. Since power supply vias and back-side wiring lines through which electric power is supplied to the antenna device 72 are the same as or similar to the power supply vias 8 and the back-side wiring lines 9 in the antenna device 2, descriptions thereof are not given hereinafter. Since a dielectric substrate on which the antenna device 72 is formed and reflectors provided in a layer in the dielectric substrate are also the same as or similar to those in the antenna device 2 described above, they are not illustrated.

The antenna device 72 includes, for example, sub-array antennas 76*a* and 76*b*. The sub-array antenna 76*a* includes antenna elements 74*a*-1 to 74*a*-3 and 74*c*-1 to 74*c*-3 and a power supply line 75*a*. The sub-array antenna 76*b* includes antenna elements 74*b*-1 to 74*b*-3, the antenna elements 74*c*-1 to 74*c*-3, and a power supply line 75*b*. The antenna elements 74*c*-1 to 74*c*-3 are shared by the sub-array antennas 76*a* and 76*b*.

Since the sub-array antennas 76*a* and 76*b* function as a time-division MIMO antenna, electric powers are supplied from the power supply points 77*a* and 77*b* at different timings (in a time-division manner), rather than being supplied therefrom at the same time.

Each antenna element is a looped-shape element having a notch 10. The orientation of the notch 10 in each of the antenna elements 74*a*-2, 74*a*-3, 74*b*-1, and 74*c*-1 to 74*c*-3 is the positive X-axis direction. The orientation of the notch 10 in each of the antenna elements 74*a*-1, 74*b*-2, and 74*b*-3 is the negative X-axis direction. The orientations of the notches 10 in the antenna device 72 are merely exemplary, and the present disclosure is not limited thereto. For example, the orientations of the notches 10 may also be set according to antenna characteristics.

The antenna elements 74*a*-1 to 74*a*-3, 74*b*-1 to 74*b*-3, and 74*c*-1 are arranged on a straight line along the X-axis direction. The antenna element 74*c*-2 is arranged in alignment with the antenna element 74*c*-1 along the Y-axis direction and in the positive Y-axis direction relative to the antenna element 74*c*-1. The antenna element 74*c*-3 is arranged in alignment with the antenna element 74*c*-1 along the Y-axis direction and in the negative Y-axis direction relative to the antenna element 74*c*-1.

The antenna elements 74*a*-1 to 74*a*-3 are arranged along the power supply line 75*a*. The power supply line 75*a* branches between the antenna elements 74*a*-1 and 74*c*-1. The branched portions of the power supply line 75*a* are formed so as to lie along the antenna elements 74*c*-2 and 74*c*-3 in accordance with the arrangements of the antenna elements 74*c*-2 and 74*c*-3.

The state of connection between each of the antenna elements 74*a*-1 to 74*a*-3 and the power supply line 75*a* and a positional relationship therebetween may also be determined, for example, depending on a system that uses the antenna device 72 in the third embodiment.

As in the first embodiment, electric power to be received by the antenna elements 74*a* can be adjusted depending on a combination of a positional relationship between the antenna element(s) 74*a* connected to the power supply line 75*a* via a metal conductor pattern and the power supply point 77*a* and a positional relationship between the antenna element(s) 74*a* that couple(s) with the power supply line 75*a* via an electromagnetic field and the power supply point 77*a*.

The antenna elements 74*b*-1 to 74*b*-3 are arranged along the power supply line 75*b*. A portion of the power supply line 75*b* branches between the antenna elements 74*b*-1 and 74*c*-1. The branched portions of the power supply line 75*b* are formed so as to lie along the antenna elements 74*c*-2 and 74*c*-3 in accordance with the arrangements of the antenna elements 74*c*-2 and 74*c*-3.

The state of connection between each of the antenna elements 74*b*-1 to 74*b*-3 and the power supply line 75*a* and a positional relationship therebetween may also be determined, for example, depending on a system that uses the antenna device 72 in the third embodiment.

As in the first embodiment, electric power to be received by the antenna elements 74*b* can be adjusted depending on a combination of a positional relationship between the antenna element(s) 74*b* connected to the power supply line 75*b* via a metal conductor pattern and the power supply point 77*b* and a positional relationship between the antenna element(s) 74*b* that couple(s) with the power supply line 75*b* via an electromagnetic field and the power supply point 77*b*.

The antenna elements 74*c*-1 to 74*c*-3 are arranged, for example, between the antenna elements 74*a*-1 and 74*b*-1 and along the power supply lines 75*a* and 75*b*. The antenna elements 74*c*-1 to 74*c*-3 couple with, for example, the power supply line 75*a* via an electromagnetic field to receive electric power from the power supply line 75*a*. The antenna elements 74*c*-1 to 74*c*-3 couple with, for example, the power supply line 75*b* via an electromagnetic field to receive electric power from the power supply line 75*b*. However, the antenna elements 74*c*-1 to 74*c*-3 do not receive electric power from both the power supply lines 75*a* and 75*b* at the same timing. The antenna elements 74*c*-1 to 74*c*-3 are not connected to the power supply lines 75*a* and 75*b* via a metal conductor pattern. The antenna elements 74*c*-1 to 74*c*-3 are placed away from the power supply lines 75*a* and 75*b*.

The sub-array antenna 76*a* is designed such that electric power supplied from the power supply line 75*a* to the antenna elements 74*c*-1 to 74*c*-3 is smaller than or equal to electric power supplied to the antenna elements 74*a*-1 and 74*a*-2.

Since the electric power is distributed at the antenna elements 74*c*-1 to 74*c*-3, the electric power supplied from the power supply line 75*a* to the antenna elements 74*c*-1 to 74*c*-3 becomes smaller than electric power supplied to the antenna element 74*a*-3.

The sub-array antenna 76*b* is also designed such that electric power supplied from the power supply line 75*b* to the antenna elements 74*c*-1 to 74*c*-3 is smaller than or equal to the electric power supplied to the antenna elements 74*b*-1 and 74*b*-2.

Also, since the electric power is distributed at the antenna elements 74*c*-1 to 74*c*-3, the electric power supplied from the power supply line 75*b* to the antenna elements 74*c*-1 to 74*c*-3 becomes smaller than the electric power supplied to the antenna element 74*b*-3.

As described above, the antenna elements 74*c*-1 to 74*c*-3 are placed away from the power supply lines 75*a* and 75*b* and do not physically contact the power supply lines 75*a* and 75*b* via a metal conductor pattern. In addition, the electric power supplied to the antenna elements 74*c*-1 to 74*c*-3 are smaller than the electric power supplied to the antenna elements 74*a*-1 to 74*a*-3 and 74*b*-1 to 74*b*-3. With this configuration, when the sub-array antenna 76*a* is performing, for example, an operation for radiating electromagnetic waves, it is possible to suppress or reduce electric power that leaks to the sub-array antenna 76*b*. Also, when the sub-array antenna 76*b* is performing, for example, an operation for radiating electromagnetic waves, it is possible to suppress or reduce electric power that leaks to the sub-array antenna 76*a*. When the sub-array antenna 76*a* performs, for example, an operation for radiating electromagnetic waves, the sub-array antenna 76*b* does not perform the operation for radiating electromagnetic waves.

It is desirable that electric power supplied to the antenna elements 74*c*-1 to 74*c*-3 be adjusted so as to be smaller than electric power supplied to the antenna elements 74*a*-1 to 74*a*-3 and 74*b*-1 to 74*b*-3.

Such adjustment of the electric power to be supplied makes it possible to suppress or reduce electric power that leaks to the sub-array antenna 76*b* when electric power is supplied to the sub-array antenna 76*a*. Also, when electric power is supplied to the sub-array antenna 76*b*, electric power that leaks to the sub-array antenna 76*a* can be suppressed or reduced.

Also, since the sub-array antennas 76*a* and 76*b* function as a time-division MIMO antenna, electric powers are supplied from the power supply points 77*a* and 77*b* to the antenna elements 74*c*-1 to 74*c*-3 at different timings (in a time-division manner), rather than being supplied therefrom at the same time. Thus, the antenna elements 74*c*-1 to 74*c*-3 operate as antenna elements for the sub-array antenna 76*a* when electric power is supplied from the power supply point 77*a* and operate as antenna elements for the sub-array antenna 76*b* when electric power is supplied from the power supply point 77*b*.

As described above, in the antenna device 62 according to the third embodiment, the sub-array antennas 66*a* and 66*b* share the antenna elements 64*c*-1 to 64*c*-3. Also, in the antenna device 72, the sub-array antennas 76*a* and 76*b* share the antenna elements 74*c*-1 and 74*c*-2. A plurality of sub-array antennas shares some of the antenna elements to thereby maintain the antenna gap, thus making it possible to increase the number of antenna elements in each sub-array antenna. Thus, it is possible to improve the antenna gain (the directional gain), to suppress or reduce unwanted sidelobes, and to improve the antenna performance.

Also, in the antenna device 62 according to the third embodiment, the antenna elements 64*c*-1 to 64*c*-3 are arranged in the vertical direction (the Y-axis direction). This configuration makes it possible to reduce not only a half-value angle in the horizontal direction (the X-axis direction) of an electromagnetic-wave main beam that the antenna device 62 radiates in the positive Z-axis direction but also a half-value angle in the vertical direction (the Y-axis direction).

Although examples in which two sub-array antennas share two and three antenna elements have been described above in the third embodiment, the present disclosure is not limited thereto. For example, even when three or more sub-array antennas are arranged along the X-axis, and adjacent sub-array antennas of the three or more sub-array antennas share the antenna elements, advantages that are analogous to those described above can be obtained.

Also, since the antenna device 72 according to the third embodiment has the plurality of antenna elements (the antenna elements 74*c*-1 to 74*c*-3) shared by two sub-array antennas, the degree of freedom of adjusting electric power supplied to the antenna elements that are shared increases. Thus, it is possible to perform more flexible design of an antenna device.

In the embodiments described above, the description has been given of examples in which a power supply point is provided at a generally center of each sub-array antenna. The present disclosure is not limited to the examples.

In addition, in the embodiments described above, the description has been given of examples in which power is supplied through back-side wiring lines. The present disclosure is not limited to the examples. For example, power may be supplied through wiring lines on an obverse side of the substrate.

In the embodiments described above, the description has been given of examples in which the number of antenna elements included in one sub-array antenna is four. The present disclosure is not limited to the examples. The number of antenna elements included in one sub-array antenna may be two, three, five, or more.

In the embodiments described above, the description has been given of examples in which the number of sub-array antennas is two. The present disclosure is not limited to the examples. The number of sub-array antennas may be three or more.

Also, two or more of the antenna devices described in each embodiment may be arranged in the X-axis direction or in the Y-axis direction.

In the embodiments described above, the description has been given of examples in which each antenna element has a looped or rectangular shape with a notch. The present disclosure is not limited to the examples. Each antenna element may be a patch antenna. Alternatively, the antenna elements included in each antenna device may include antenna elements having different shapes. For example, of the antenna elements included in each sub-array antenna, each antenna element that is shared by the sub-array antenna and another sub-array antenna may be a patch antenna, and each antenna element other than the antenna element(s) that is (are) shared may be an antenna element having a shape different from the patch antenna(s).

Also, in the embodiments described above, the description has been given of one or more antenna elements shared by a plurality of sub-array antennas. Each antenna element shared by a plurality of sub-array antennas may also be referred to as an "antenna element owned by a plurality of sub-array antennas.

The above-described functional blocks used in the description of the embodiments can typically be realized as a large-scale integration (LSI), which is an integrated circuit. The integrated circuit may control the individual functional blocks used in the description of the embodiments and may have an input and an output. The functional blocks may be individually integrated into single chips or at least one or all of the functional blocks may be integrated into a single chip. Although the functional blocks are implemented in the form of an LSI in this case, they may also be called an integrated circuit (IC), a system LSI, a super LSI, or an ultra LSI depending on a difference in the degree of integration.

The scheme for integrating the functional blocks into an integrated circuit is not limited to a scheme for LSI and may be realized using a dedicated circuit or a general-purpose processor. The functional blocks can also be implemented using a field programmable gate array (FPGA) that can be programmed after manufacture of an LSI or a reconfigurable processor that allows reconfiguration of connections or settings of circuit cells in an LSI.

In addition, when a circuit integration technology that replaces LSI becomes available with the advancement of semiconductor technology or another derivative technology, such a technology may also naturally be used to integrate the functional blocks. For example, biotechnology is applicable.

The present disclosure can also be implemented as a radio communication device or a control method executed by a control device. The present disclosure can also be implemented by a program for causing a computer to realize the control method. In addition, the present disclosure can also be implemented as a recording medium in which such a program is stored in a computer readable state. That is, the present disclosure can be implemented by any category of an apparatus, a device, a method, a program, and a recording medium.

The present disclosure can also be implemented as any types of apparatus, device, and system having communication functions (these are collectively referred to as "communication apparatuses"). Non-limiting examples of the communication apparatuses include phones (such as mobile phones and smartphones), tablet computers, personal computers (PCs, such as laptop, desktop, and notebook PCs), cameras (such as digital still/video cameras), digital players (such as digital audio/video players), wearable devices (such as wearable cameras, smartwatches, and tracking devices), game consoles, digital book readers, telehealth and telemedicine (remote healthcare and medicine prescription) devices, vehicles or transport systems (such as automobiles, airplanes, and ships) with communication functions, and any combination of the above-described various apparatuses.

The communication apparatuses are not limited to portable or movable communication apparatuses and include any types of apparatus, device, and system that are non-portable or fixed. Examples of such communication apparatuses include smart home devices (such as household electrical and electronic equipment, lighting equipment, smart meters, and measurement equipment, and control panels), vending machines, and any "things" that exist on IoT (Internet of Things) networks.

Communication performed by the communication apparatuses include data communication using cellular systems, wireless local-area network (LAN) systems, and communication satellite systems and data communication using a combination of these systems.

The communication apparatuses also include devices, such as controllers and sensors, that are connected or coupled to communication devices (described below in the present disclosure) that execute a communication function. For example, the communication apparatuses include controllers and sensors that generate control signals and/or data signals used by communication devices that execute communication functions of the communication apparatuses.

The communication apparatuses further include infrastructure equipment that performs communication with the above-described various non-limiting apparatuses or that controls the various apparatuses. Examples of the infrastructure equipment include base stations, access points, and any other apparatuses, devices, and systems.

Although some embodiments have been described above with reference to the accompanying drawings, it goes without saying that the present disclosure is not limited to such examples. It is apparent to those skilled in the art that various variations and modifications can be conceived within the scope recited in the claims, and it is to be understood that such variations and modifications also naturally belong to the technical scope of the present disclosure. The constituent elements in the above-described embodiments may also be arbitrarily combined within a scope that does not depart from the spirit of the disclosure.

<Brief Summary of the Present Disclosure>

An antenna device in the present disclosure includes: a first sub-array antenna provided on a substrate and having a group of first antenna elements, one or more third antenna elements, and a first electrical power line through which electric power is supplied to the group of first antenna elements and the one or more third antenna elements; and a second sub-array antenna provided on the substrate and having a group of second antenna elements, the one or more third antenna elements, and a second electrical power line through which electric power is supplied to the group of second antenna elements and the one or more third antenna elements. The one or more third antenna elements are placed away from the first electrical power line and the second electrical power line.

In the antenna device in the present disclosure, the one or more third antenna elements may couple with the first electrical power line and the second electrical power line via an electromagnetic field.

In the antenna device in the present disclosure, supply of electric power to the first sub-array antenna and supply of electric power to the second sub-array antenna may be performed in a time-division manner.

In the antenna device in the present disclosure a distance between a center of the first sub-array antenna and a center of the second sub-array antenna in a first direction may be smaller than a length of the first sub-array antenna in the first direction and a length of the second sub-array antenna in the first direction.

In the antenna device in the present disclosure, electric power supplied to the one or more third antenna elements through the first electrical power line may be smaller than or equal to electric power supplied to the group of first antenna elements through the first electrical power line; and electric power supplied to the one or more third antenna elements through the second electrical power line may be smaller than or equal to electric power supplied to the group of second antenna elements through the second electrical power line.

In the antenna device in the present disclosure, at least one of the group of first antenna elements and the group of second antenna elements may include antenna elements arranged along the first direction and antenna elements arranged along a second direction orthogonal to the first direction.

In the antenna device in the present disclosure, the first sub-array antenna and the second sub-array antenna may radiate electromagnetic waves in a frequency band higher than or equal to 10 GHz.

In the antenna device in the present disclosure, the number of first sub-array antennas and the number of second sub-array antennas may be each two or more.

The antenna devices according to the present disclosure are preferably applied to radar devices and so on.

What is claimed is:

1. An antenna device comprising:

a first sub-array antenna provided on a substrate and having a group of first antenna elements, one or more third antenna elements, and a first electrical power line through which electric power is supplied to the group of first antenna elements and the one or more third antenna elements; and a second sub-array antenna provided on the substrate and having a group of second antenna elements, the one or more third antenna elements, and a second electrical power line through which electric power is supplied to the group of second antenna elements and the one or more third antenna elements, wherein the one or more third antenna elements are placed away from the first electrical power line and the second electrical power line.

2. The antenna device according to claim 1, wherein the one or more third antenna elements couple with the first electrical power line and the second electrical power line via an electromagnetic field.

3. The antenna device according to claim 1, wherein supply of electric power to the first sub-array antenna and supply of electric power to the second sub-array antenna are performed in a time-division manner.

4. The antenna device according to claim 1, wherein a distance between a center of the first sub-array antenna and a center of the second sub-array antenna in a first direction is smaller than a length of the first sub-array antenna in the first direction and a length of the second sub-array antenna in the first direction.

5. The antenna device according to claim 1, wherein electric power supplied to the one or more third antenna elements through the first electrical power line is smaller than or equal to electric power supplied to the group of first antenna elements through the first electrical power line; and wherein electric power supplied to the one or more third antenna elements through the second electrical power line is smaller than or equal to electric power supplied to the group of second antenna elements through the second electrical power line.

6. The antenna device according to claim 1, wherein at least one of the group of first antenna elements and the group of second antenna elements includes antenna elements arranged along the first direction and antenna elements arranged along a second direction orthogonal to the first direction.

7. The antenna device according to claim 1, wherein the first sub-array antenna and the second sub-array antenna radiate electromagnetic waves in a frequency band higher than or equal to 10 gigahertz.

8. The antenna device according to claim 1, wherein the number of first sub-array antennas and the number of second sub-array antennas are each two or more.

* * * * *